United States Patent [19]

Nikolov, deceased et al.

[11] Patent Number: 4,616,808

[45] Date of Patent: Oct. 14, 1986

[54] APPARATUS FOR THE TREATMENT AND CASTING OF METALS AND ALLOYS IN A CLOSED SPACE

[75] Inventors: Ivan D. Nikolov, deceased, late of Sofia; by Vassilka P. Dimova, heir, Sofia; Dobromir I. Dimov, heir, Sofia; Petar I. Dimov, heir, Sofia; Marin I. Marinov, Sofia; Ivan M. Peytchev, Sofia; Tzolo V. Rashev, Sofia; Iliya G. Tchorbov, Sofia, all of Bulgaria

[73] Assignee: Institute po Metaloznanie i Technologia na Metalite, Sofia, Bulgaria

[21] Appl. No.: 698,086

[22] Filed: Feb. 4, 1985

[51] Int. Cl.[4] ..... C21C 7/10

[52] U.S. Cl. ..... 266/207; 75/49; 75/59.31; 75/65 EB

[58] Field of Search ..... 75/59.31, 65 R, 65 EB, 75/129, 49; 266/207

[56] References Cited

U.S. PATENT DOCUMENTS 3,342,250 9/1967 Treppschule ..... 75/65 R 4,533,413 8/1985 Miura ..... 266/207

*Primary Examiner*—Peter D. Rosenberg

[57] ABSTRACT

A method in which the melt is first treated with solid alloying additives and an alloying gas, and then the casting operation is effected. There is produced a differential between the pressures in the space for additional saturation with alloying gas and in the space where the casting takes place.

An apparatus for practicing the above method comprising an induction furnace in a first hermetic chamber, and a second hermetic chamber inside which there is mounted a casting mold. The induction furnace and the first hermetic chamber are interconnected with the second hermetic chamber via a movable launder. Above the one end of the movable launder there is mounted a siphon, underneath its other end there is disposed an tundish, which is mounted inside the first hermetic chamber and is gas-tightly sealed against a separating plate, attached to the second hermetic chamber containing the casting mold. The tundish is provided with a bottom for blowing-through with alloying gas.

2 Claims, 3 Drawing Figures

APPARATUS FOR THE TREATMENT AND CASTING OF METALS AND ALLOYS IN A CLOSED SPACE

This invention relates to a method of and an apparatus for the treatment and casting of metals and alloys in a closed space, which can be used to advantage in foundry engineering for the production of castings.

In a known method for the treatment and casting of metals and alloys in a closed space, the molten metal is poured into an induction furnace and is then treated with solid alloying additives, the molten metal being under the action of a gas pressure. Simultaneously there is effected an additional saturation of the melt with the alloying additives by delivering an alloying gas through the bottom of the furnace. After the termination of the process of treatment of the melt, the thus alloyed molten metal enters the mold and the casting takes place under gas pressure.

A known apparatus for effecting this method comprises an induction furnace, the bottom of which is connected to a source of alloying gas. The space of the induction furnace is connected to a hermetic chamber inside which a mold is disposed.

A drawback of such method and apparatus lies in the fact that the metal melt enters the mold directly from the induction furnace and, since part of the alloying elements are added in solid state, the non-metallic inclusions cannot be totally separated. They enter the mold together with the alloyed liquid metal and, as a result, the quality of the casting thus produced is impaired.

In a known method disclosed in West German Pat. No. 1,143,606 for treatment and casting of metals and alloys, the melt is poured into an induction furnace and vacuum is produced. Then follow the alloying of the melt and the casting is carried our under the action of a vacuum. The liquid metal of the casting solidifies in a space separate from the space of the induction furnace.

A drawback of this method lies in the fact that it is impossible to cast gas-alloyed melts, because when the vacuum is produced, the alloying gas dissolved in the melt is released together with the remaining gases. This results in the production of low-quality castings.

A known apparatus, likewise disclosed in West German Pat. No. 1,143,606, for effecting this method, comprises an induction furnace connected by a movable launder (or chute) to a hermetic chamber, inside which a casting mold or die is mounted. The space of the hermetic chamber and the space of the induction furnace are separated by means of a gas valve.

A drawback of this apparatus lies in the fact that it cannot provide a floating-up and retaining of the non-metallic inclusions separate from the alloyed melt and, because of this, the quality of the castings is impaired.

It is therefore a general object of this invention to provide a method of and an apparatus for the treatment and casting of metals and alloys in a closed space, which can provide an effective additional alloying of the melt and an intensive mechanical purification of the alloyed melt from the non-metallic inclusions with the object of producing high-quality castings.

This object is achieved by a method in accordance wih the invention in which the melt is first treated with solid alloying additives and an alloying gas, and then the casting operation is effected. The treatment and casting take place under the action of a gas pressure. In accordance with the invention, the melt is first treated with the solid alloying additives, and is then subjected to additional saturation with alloying gas, these two treatments being effected separately. The process of casting is effected gravitationally. Simultaneously, there is produced a differential between the pressures in the space for additional saturation with alloying gas and in the space where the casting takes place.

This object is also achieved by an apparatus which comprises an induction furnace and a hermetic chamber, inside which a casting mold is mounted. The induction furnace and the hermetic chamber are interconnected by a movable launder (chute). According to the invention, above the one end of the movable launder (chute) there is mounted a siphon, and underneath its other end there is mounted a tundish, disposed inside a hermetic chamber and gas-tightly sealed against a separating plate. The tundish is provided with a bottom for blowing-through with alloying gas, a bath for the slag, a device for heating-up, and a system for blowing-through. The separating plate is attached to the second hermetic chamber containing the casting mold. The movable launder is provided with a device for blowing-through the melt with alloying gas.

The advantages of the method and the apparatus of the invention lie in that:

- by the divisional saturation of the melt with alloying elements there is effected a good separation of the non-metallic inclusions in the melt during its blowing-through with the alloying gas in the tundish, thus ensuring the production of high-quality castings;
- by the production of a differential between the pressure in the space of the intermediate and in the space containing the casting mold there is provided an additional control of the rate of casting, thus also resulting in an improvement of the quality of the castings;
- the gas used for alloying and blowing-through causes an increase of the pressure only in the space of the tundish and the mold, thus resulting in an increase of the assimilation of the alloying gas and an improvement of the conditions of crystallization, without the necessity of consuming gas for increasing the pressure in the furnace;
- after the fast pouring of the metal from the crucible to the tundish, the melting unit can be made free for a new cycle; this results in an increase of the utilization factor of the most expensive unit of the apparatus, i.e. the furnace;
- after the filling of the molds with melt, they remain immovable during the time of crystallization, and thus the danger of appearance of defects in the not-yet strong enough metal skin as a result of jolting is avoided.

For a better understanding of the invention, reference should be made to the accompanying drawings in which there is illustrated and described a preferred embodiment of an apparatus for practicing the method of the invention. In the drawings.

Figure 1:
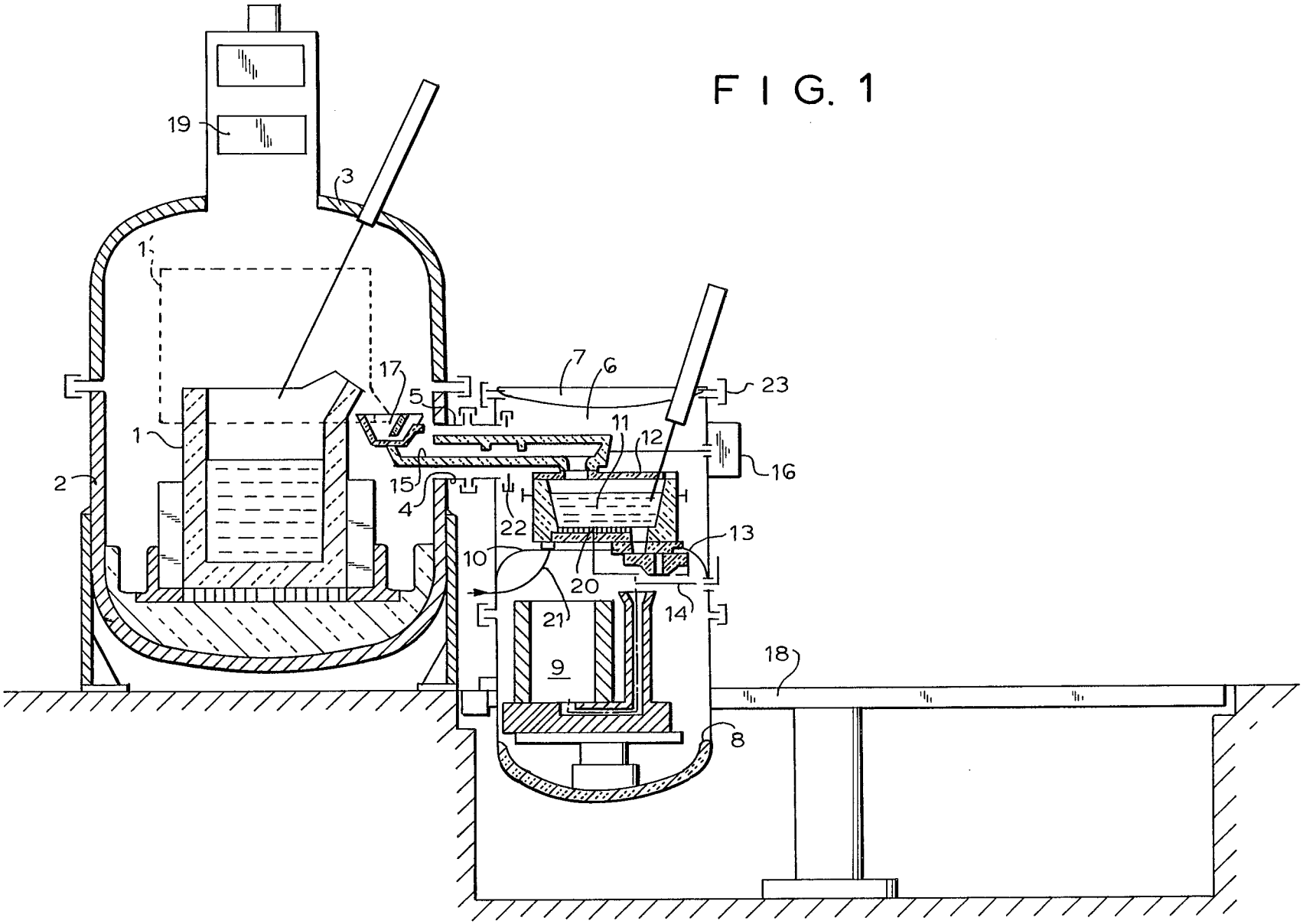
FIG. 1 is a diagrammatic cross-sectional view of the apparatus.
Figure 2:
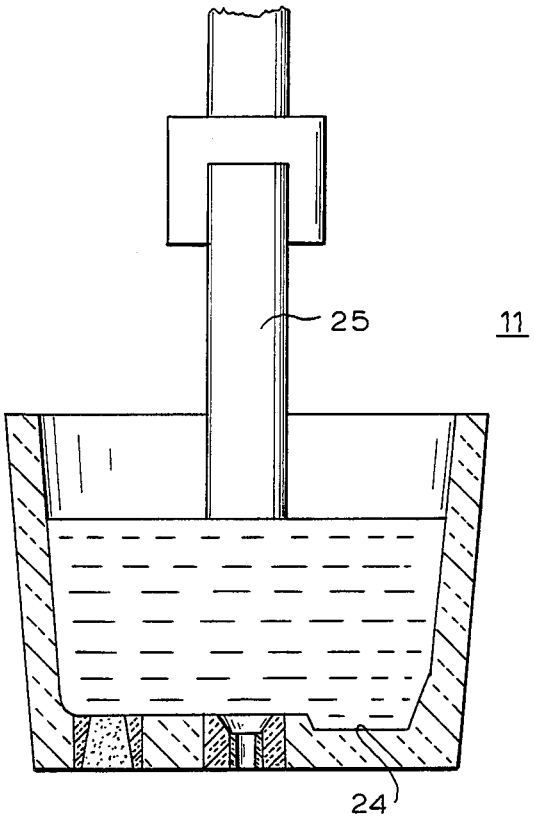
FIG. 2 is a longitudinal cross-sectional view of the tundish with heating by means of an electrode.
Figure 3:
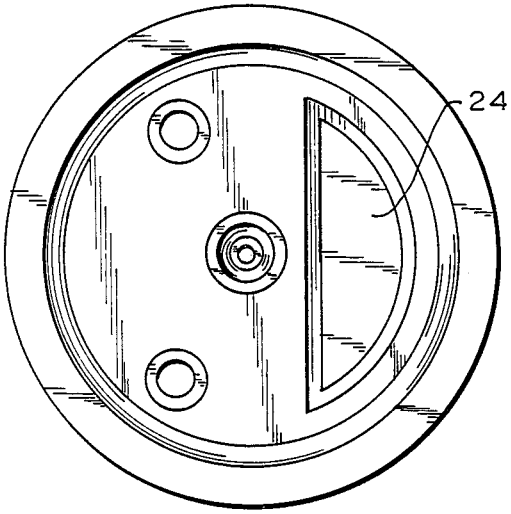
FIG. 3 is a view in the downward direction A in FIG. 2.

The illustrative apparatus shown in the drawing comprises an induction furnace 1, mounted inside a hood 2 with a cover 3. The hood 2 is connected by a pipe 4 and a first quick-acting joint 5 to a first hermetic chamber 6, provided with a cover 7. Underneath the first hermetic chamber 6 there is mounted a second hermetic chamber 8, inside which a casting mold 9 is disclosed. The hermetic-sealed chambers 6 and 8 are separated from each other by a plate 10. Above the separating plate 10, inside the first hermetic chamber 6, there is mounted an tundish 11 with a cover 12, and the tundish is gas-tightly sealed against the separating plate 10. On the bottom side of the separating plate 10 there is mounted a slide valve for liquid metal 13 with a small gas valve 14. Above the tundish 11, there is mounted a movable launder 15 with a actuating mechanism 16, the movable launder 15 being mounted in a pipe 4.

In the one end of the movable launder 15, on the side thereof towards the induction furnace 1, there is provided a siphon 17. Both hermetically-sealed chambers 6 and 8 are placed on a turntable 18. To the cover 3 of the hood 2—above the induction furnace 1—there is mounted a device for the supplying of solid alloying additives 19. The tundish 11 is provided with a bottom for the blowing-through 20, connected to a system for blowing-through with alloying gas 21. The first hermetic chamber 6 is provided with a large-size gas slide valve 22. The first hermetic chamber 6 and the cover 7 are connected by a second quick-acting joint 23. The tundish 11 is provided with a bath 24 for the slag and a device 25 for heating-up the melt. The above-described apparatus operates as follows:

The melt is poured into the induction furnace 1, and the first hermetic chamber 6, inside which the tundish 11 is mounted, is connected by the first quick-acting joint 5 to the system for increase pressure. By means of the device 19 for the supply of solid alloying additives, these additives are poured into the melt. After their assimilation, the induction furnace 1 is tilted on opposed trunnions disposed in its upper part up to the horizontal position 1' shown in dash lines in FIG. 1. The melt then flows from the thus tipped furnace and the then melt enters the siphon 17 from which it overflows via the movable launder 15 into the tundish 11 which can take up the whole quality of the melt. There, by means of a system 21 for blowing-through with alloying gas through the bottom 20, the melt is additionally alloyed and freed from non-metallic inclusions, which have not retained in the siphon 17. The movable launder 15 is pulled by means of the actuating mechanism 16 above the tundish 11 and large-size gas slide valve 22 is closed.

The pressure in the space of the induction furnace 1 is released while, by means of the first quick-acting joint 5, both spaces—of the induction furnace 1 and of the tundish 11—are separated. The turntable 18 is rotated and both hermetic chambers 6 and 8 come into a "crystallization position" (a not-working position). In this position, the melt is additionally purified and alloyed by blowing-through alloying gas, and then the melt enters the casting mold 9 through the slide valve 13 for molten metal. The small gas slide valve 14 is closed and the cast metal body cools down under increased pressure. In the meantime, the gas in the tundish 11 is released, the second quick-acting joint 23 is opened, and the movable launder 15 and tundish 11 are taken out to be placed in other chambers, while the production process continues. After the crystalization of the melt in the casting mold 9, the pressure in the second hermetic chamber 8 is released and the cast metal or alloy body is taken out.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. In an apparatus for treating and casting metals and alloys, said apparatus including an induction furnace and a hermetic chamber, inside which there is disposed a casting mold, the induction furnace and the hermetic chamber being interconnected by a movable launder, the improvement wherein above one end of the movable launder there is mounted a siphon, and underneath its other end there is disposed a tundish which is mounted inside a first hermetic chamber that is gas-tightly sealed against a separating plate attached to a second hermetic chamber containing the casting mold, the tundish being provided with a bottom for blowing-through with alloying gas.

2. An apparatus according to claim 1, wherein the tundish is provided with a system for blowing-through with alloying gas, a bath for slag, and a device for heating-up the melt in the tundish.

* * * * *